US007775857B2

(12) United States Patent
Jonkheijm et al.

(10) Patent No.: US 7,775,857 B2
(45) Date of Patent: Aug. 17, 2010

(54) DEVICE FOR PARTICLE BLASTING

(75) Inventors: Erwin Jonkheijm, Sint-Denijs-Westrem (BE); Annick Claes, Sint-Denijs-Westrem (BE)

(73) Assignee: Artimpex N.V., Sint-Denijs-Westrem (BE)

( * ) Notice: Subject to any disclaimer, the term of this patent is extended or adjusted under 35 U.S.C. 154(b) by 481 days.

(21) Appl. No.: 11/827,655

(22) Filed: Jul. 12, 2007

(65) Prior Publication Data

US 2008/0013399 A1 Jan. 17, 2008

(30) Foreign Application Priority Data

Jul. 14, 2006 (BE) ..... 2006/0390

(51) Int. Cl.
*B24B 1/00* (2006.01)

(52) U.S. Cl. ..... 451/40; 451/99

(58) Field of Classification Search ..... 451/40, 451/99

See application file for complete search history.

(56) References Cited

U.S. PATENT DOCUMENTS 4,703,590 A * 11/1987 Westergaard ..... 451/39
5,445,553 A * 8/1995 Cryer et al. ..... 451/7
5,492,497 A * 2/1996 Brooke et al. ..... 451/99
2003/0064665 A1 * 4/2003 Opel ..... 451/40

FOREIGN PATENT DOCUMENTS

DE 10 2004 045770 8/2005
EP 1 340592 9/2003

* cited by examiner

*Primary Examiner*—Maurina Rachuba
(74) *Attorney, Agent, or Firm*—James Creighton Wray; Meera P. Narasimhan

(57) ABSTRACT

This invention relates to a device for particle blasting, comprising a mixing device for mixing the particles and the carrier gas. The mixing device comprises, on the one hand, a mixing plate (3) wherein at least one supply channel (6) for the carrier gas, at least one supply channel for the particles (14) and at least one discharge channel (7) for the mixture are provided, and on the other hand, comprises a rotatable distribution disc (1) provided with cavities (2), which during rotation are positioned in such a way that they are first filled with particles and then form a temporary connection between the supply channel (6) and the discharge channel (7), with the result that the carrier gas and the particles are mixed. Since both the supply channel and the discharge channel are provided in one and the same element, the seal between mixing plate and rotor is easy to achieve.

13 Claims, 6 Drawing Sheets

DEVICE FOR PARTICLE BLASTING

This application claims the benefit of Belgian Application No. 2006/0390 filed Jul. 14, 2006, which is hereby incorporated by reference in its entirety.

This invention relates to a device for particle blasting, comprising:

first supply means for a carrier gas;

second supply means for particles;

a mixing device provided for mixing the particles and the carrier gas, comprising a rotatable distribution disc with one or more cavities, which is provided in order to bring the particles into contact with the carrier gas;

discharge means provided for discharging the mixture formed.

In particular, this invention relates to a device for dry ice blasting.

BACKGROUND OF THE INVENTION

In order to tackle stubborn dirt, we all too readily turn to the heavy-duty means: sandblasting, corrosive products and solvents, high-pressure cleaning, sanding, brushes etc.

These solutions are far from ideal, as they are often aggressive, harmful to the substrate, downright dangerous, or even environmentally polluting. Yet there is a solution that is effective, efficient and virtually universally usable: dry ice blasting.

Dry ice blasting uses solid $CO_2$ pellets as the particles and a carrier gas, preferably compressed air, to accelerate the pellets in the direction of the surface to be treated.

A dry ice device is generally composed of a feed hopper filled with particles, a mixing device for mixing the particles with the carrier gas, and one or more discharge means to which a gun can be connected in order to project the particles towards the surface to be treated. In most cases the mixing device will regulate the particle consumption.

There are various types of mixing devices for such dry ice devices. A commonly used type is the driven rotor with holes. Such a type is disclosed in European patent application EP 1 340 592. According to this patent application, the mixing device comprises a disc rotatably disposed between two non-rotatable plates and rotatable about a vertical axis. The disc has two functions:

1) to accommodate the particles present in the feed hopper in the holes of the disc rotating below the top plates;

2) to bring the filled holes into contact with a carrier gas.

Varying the speed of rotation of the disc can regulate the particle consumption.

Another type of mixing device used is disclosed in the international patent publication WO 03089193. According to this patent publication, the mixing device comprises a cylinder, which on its outer circumference is provided with cavities or recesses. The cylinder is rotatable about a horizontal axis and is disposed between a top chamber where the openings are filled with particles from the feed hopper and a bottom chamber where the particles are mixed into the carrier gas flow. The particle consumption can likewise be regulated by varying the speed of rotation of the disc.

Since the design of the known devices is fairly complex, one of the great challenges of the known systems is to achieve a good seal between the rotating rotor and the non-rotatable discs or chambers. The device wherein the rotor is rotatable about a vertical axis makes use of sealing discs disposed in a stationary position above and below the rotor, and partially or fully covering the rotor. The pressure at which the seal is produced can be regulated by means of springs or sealing elements, which make the construction of the whole unit even more complex.

The seal of the mixing devices with a rotor that is rotatable about a horizontal axis has to be provided on the outer circumference, which results in a very complex construction of the top and bottom chamber, and in high motor torque. In order to maintain the seal at raised pressure and without a high motor torque, complex bottom chambers with flexible inside walls and various seals have already been developed. SUMMARY OF THE INVENTION The object of the invention is to provide a device for particle blasting wherein the seal of the mixing device can be achieved in a simple manner.

The object of the invention is achieved by providing a device for particle blasting comprising:

first supply means for a carrier gas;

second supply means for particles;

a mixing device provided for mixing the particles and the carrier gas, comprising a rotatable distribution disc with one or more cavities, which is provided in order to bring the particles into contact with the carrier gas;

discharge means provided for discharging the mixture formed;

wherein the mixing device comprises a mixing plate provided with at least one supply channel for the carrier gas and at least one discharge channel for the mixture, and wherein the rotatable distribution disc is provided in order to position the cavities in such a way during rotation that they form a temporary connection between the at least one supply channel and the at least one discharge channel. The great advantage of the device according to the invention is that the device need only be sealed in one plane. The seal of the rotatable distribution disc and mixing plate is much simpler, since the rotatable distribution disc is exposed on only one side to the carrier gas under pressure, and therefore has to seal only on one fixed element. Where the known devices use two non-rotatable elements that are in contact with the particles and the rotatable distribution disc, the device according to the invention has only one non-rotatable element, namely the mixing plate.

Since both the supply channel and the discharge channel provided are situated in one and the same element, a very simple arrangement is obtained, and said arrangement has yet another advantage. It is namely that, if the pressure of the carrier gas gets lost during rotation of the distribution disc, in the known devices, as a result of the force of gravity, the inlet and/or outlet of the carrier gas channel will be filled with particles. If the particles are solid $CO_2$ pellets, it can happen that the inlet and/or outlet of the channel is/are blocked as a result of the frozen pellets. In the device according to this invention there is no risk of the inlet or outlet becoming blocked with pellets if the pressure of the carrier gas gets lost and the distribution disc continues to rotate, since the pellets will not leave the cavities in the distribution disc as a result of the force of gravity.

The carrier gas used in the device according to the invention is in particular compressed air, but it can also be another known carrier gas. The particles are preferably $CO_2$ pellets or a mixture of $CO_2$ pellets and another material such as, e.g., silicates, salt crystals and the like. The particles can be supplied to the device in the form of scrapings (e.g. from blocks), flakes or powder.

In a preferred embodiment of the device according to the invention a dividing wall is provided between the supply channel and the discharge channel, and the channels are provided in order to achieve the said connection at the level of the dividing wall.

According to a more preferred embodiment of the device according to the invention, the mixing device comprises a non-rotatable sealing plate, which is disposed between the mixing plate and the rotatable distribution disc. In a preferred embodiment the said non-rotatable sealing plate is composed of a plurality of layers, so that, inter alia, the layer that could possibly be subject to wear is easy to replace.

According to a special embodiment of the device according to the invention, the said sealing plate comprises at least one first aperture, which is in communication with the second supply means, and the said sealing plate comprises at least one second aperture at the level of the dividing wall, the second aperture connecting to both the supply channel and the discharge channel.

According to a preferred embodiment of the device according to the invention, the mixing device comprises cutting means for reducing the size of the particles fed in. The cutting means are preferably disposed between the mixing plate and the rotatable distribution disc.

In a particularly advantageous embodiment of the device according to the invention the rotatable distribution disc comprises at least one series of cavities placed at regular intervals and at equal distances relative to the centre point of the disc, which cavities during rotation of the distribution disc form a temporary connection between the at least one supply channel and the at least one discharge channel. During rotation of the distribution disc the cavities placed at regular intervals and at equal distances relative to the centre point of the disc will preferably connect alternately to the first and second apertures. In a special embodiment of the device according to the invention the number of cavities per series is an odd number. If this is combined with two filling apertures, two first apertures and two second apertures which give access to the discharge channel, it results in uniform mixing of the particles with the carrier gas and, furthermore, the undesirable pulsing (jolting) effect is reduced.

Even better mixing of the particles with the carrier gas is obtained in a special embodiment of the device according to the invention, wherein the rotatable distribution disc comprises a first series and a second series of cavities, the said series of cavities being placed at a first and a second distance respectively from the centre point of the disc. In particular, the first and second series of cavities are in an offset position relative to each other.

According to a preferred embodiment of the device, the device comprises pressure means for pressing the rotatable distribution disc against the mixing plate. The said pressure means preferably press the rotatable distribution disc against the mixing plate along one side.

In particular, the said pressure means comprise a pressure chamber, and the pressure exerted by the pressure chamber is proportional to the pressure of the carrier gas. This has the advantage that a pressure-dependent seal is achieved and unnecessary friction and subsequent wear at lower pressures is avoided. In a preferred embodiment the said pressure chamber is situated outside the mixing device.

In a most special embodiment of the device according to the invention the said device is a dry ice blasting device.

In order to explain the features of this invention further and to indicate additional advantages and details of it, there now follows a more detailed description of a device for pellet blasting according to the invention. It should be clear that nothing in the description that follows can be interpreted as a limitation of the protection for the device according to the invention demanded in the claims.

In this description reference is made by means of reference numerals to the appended drawings, wherein:

DETAILED DESCRIPTION OF THE PREFERRED EMBODIMENTS

Dry ice blasting is a blasting technique that is comparable to sandblasting or high-pressure water blasting, but it makes use of, inter alia, solid $CO_2$ pellets, also known as "dry ice pellets", powder or flakes as the pellets. The great difference from the other blasting techniques is twofold. On the one hand, the pellets are very cold (−78° C.), with the result that the contamination layer suddenly cools down and shrinks. This means that this layer comes away easily from the substrate. On the other hand, the $CO_2$ pellets sublime after they have touched the surface, which means that no additional waste is generated. This is directly one of the greatest advantages of dry ice blasting.

Figure 1:
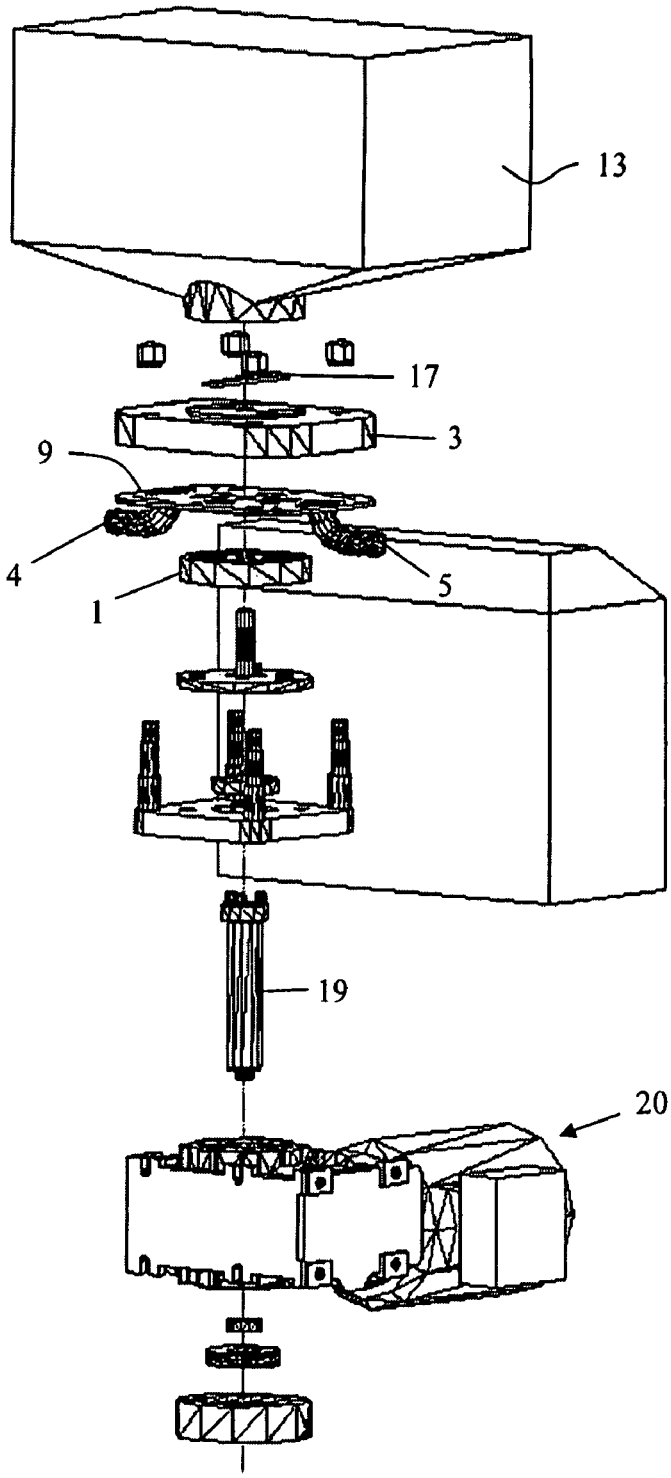
FIG. 1 is a perspective view of a device for particle blasting.
Figure 2:
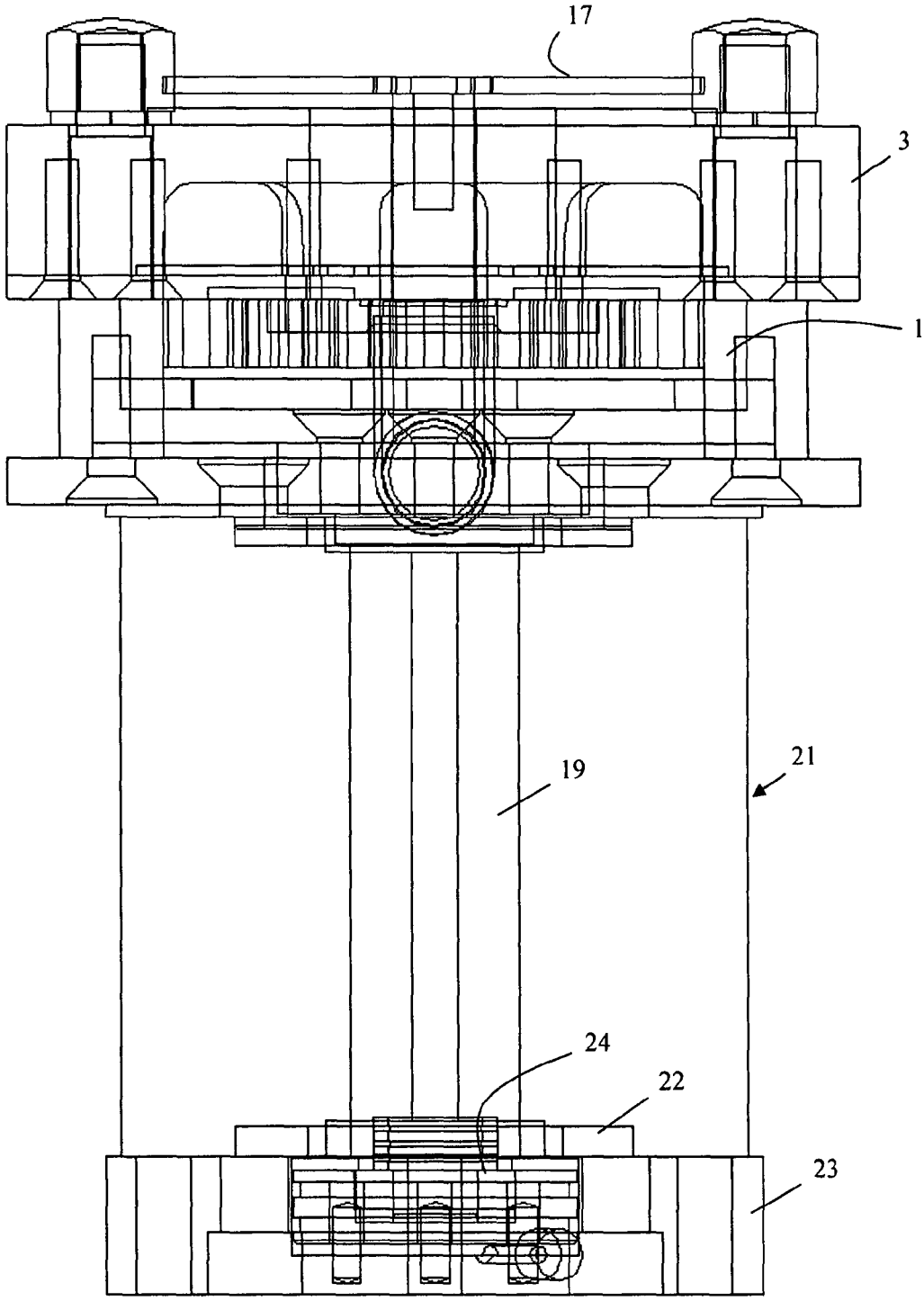
FIG. 2 is a vertical cross section of the device according to the invention.

A device for particle blasting according to this invention and as illustrated in FIG. 1 comprises:

- first supply means (4) for a carrier gas;
- second supply means for particles, the particles (such as, e.g., solid $CO_2$ pellets) preferably being provided in a feed hopper (13);
- a mixing device for mixing the particles with the carrier gas;
- one or more discharge means (5) to which a gun can be connected in order to project the particles towards the surface to be treated.

Figure 3:
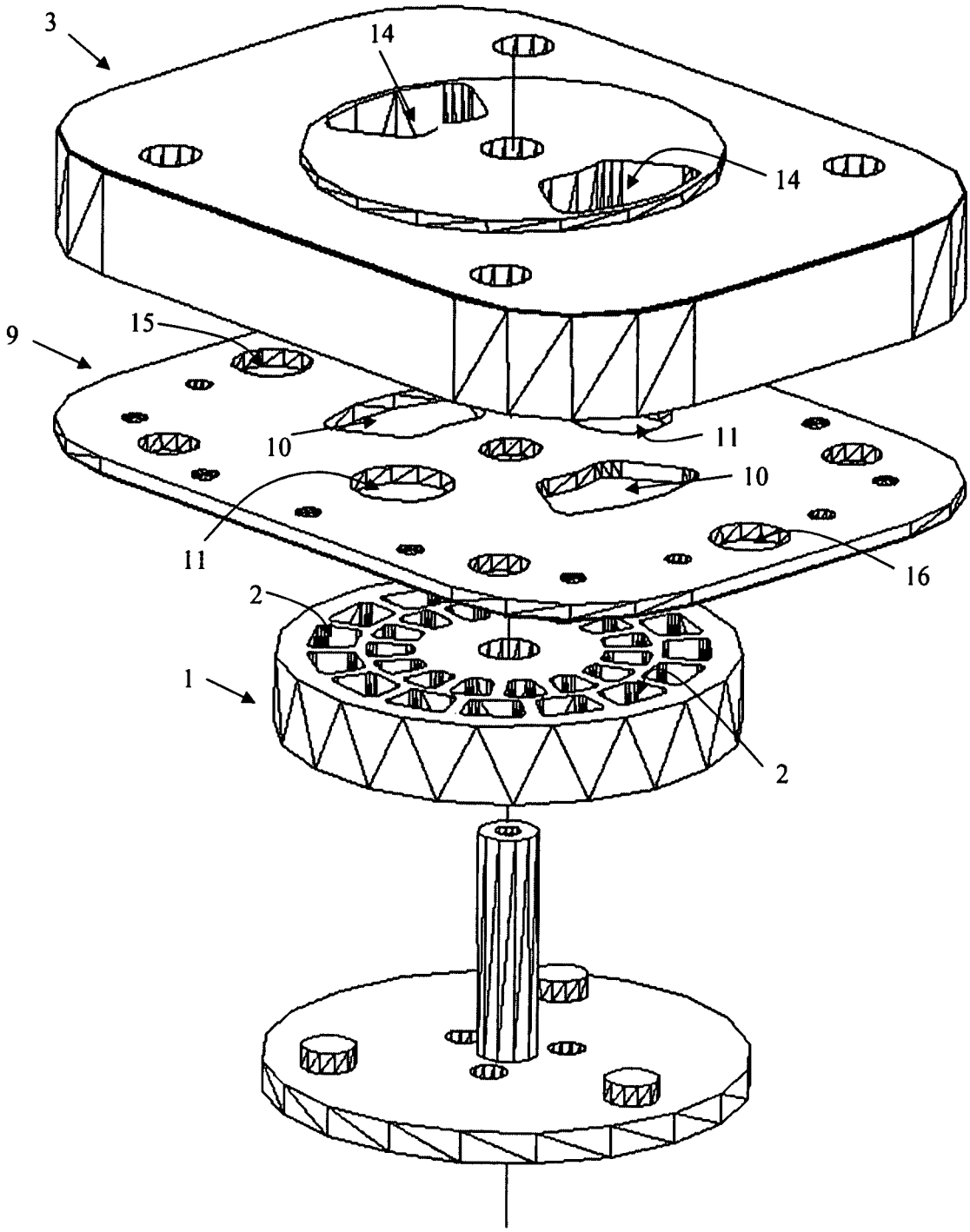
FIG. 3 is a top view of the mixing device.
Figure 4:
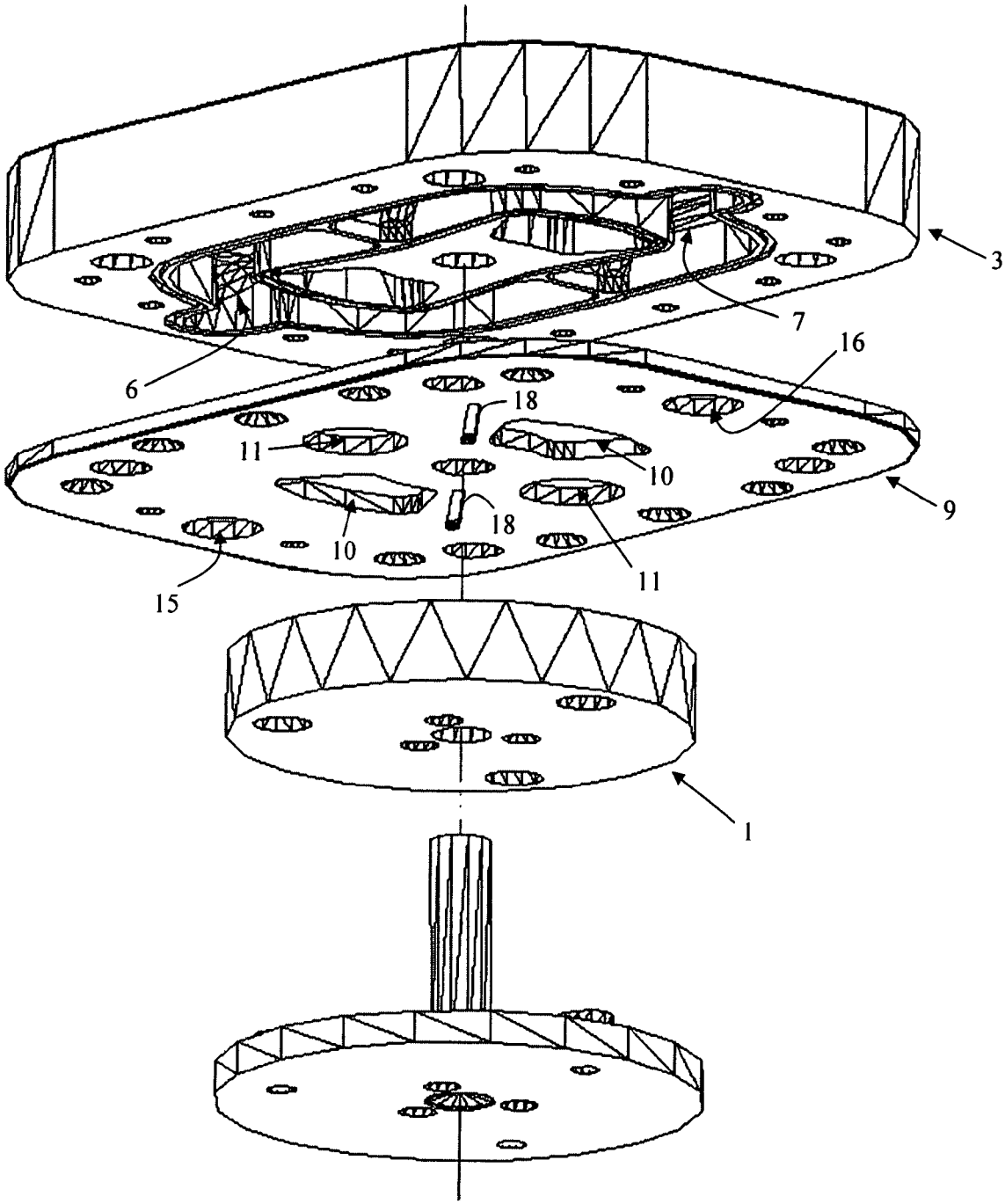
FIG. 4 is a bottom view of the mixing device.

The mixing device as illustrated in FIGS. 3 and 4 comprises, on the one hand, a mixing plate (3) wherein at least one supply channel (6) for the carrier gas and at least one discharge channel (7) for the mixture are provided. On the other hand, the mixing device comprises a rotatable distribution disc (1), which rotates about a vertical axis and in its upper surface is provided with one or more cavities (2). The rotatable distribution disc (1) is situated below the mixing plate (3) and is provided for the purpose of positioning the cavities (2) in such a way during rotation of the distribution disc (1) that they form a temporary connection between the supply channel (6) and the discharge channel (7). The distribution disc (1) can be composed of one or more parts (for dimensional stability). Furthermore, the mixing device comprises a non-rotatable sealing plate (9), which is disposed between the mixing plate (3) and the rotatable distribution disc (1). Said sealing plate (9) may, if desired, be composed of a plurality of layers.

Figure 5:
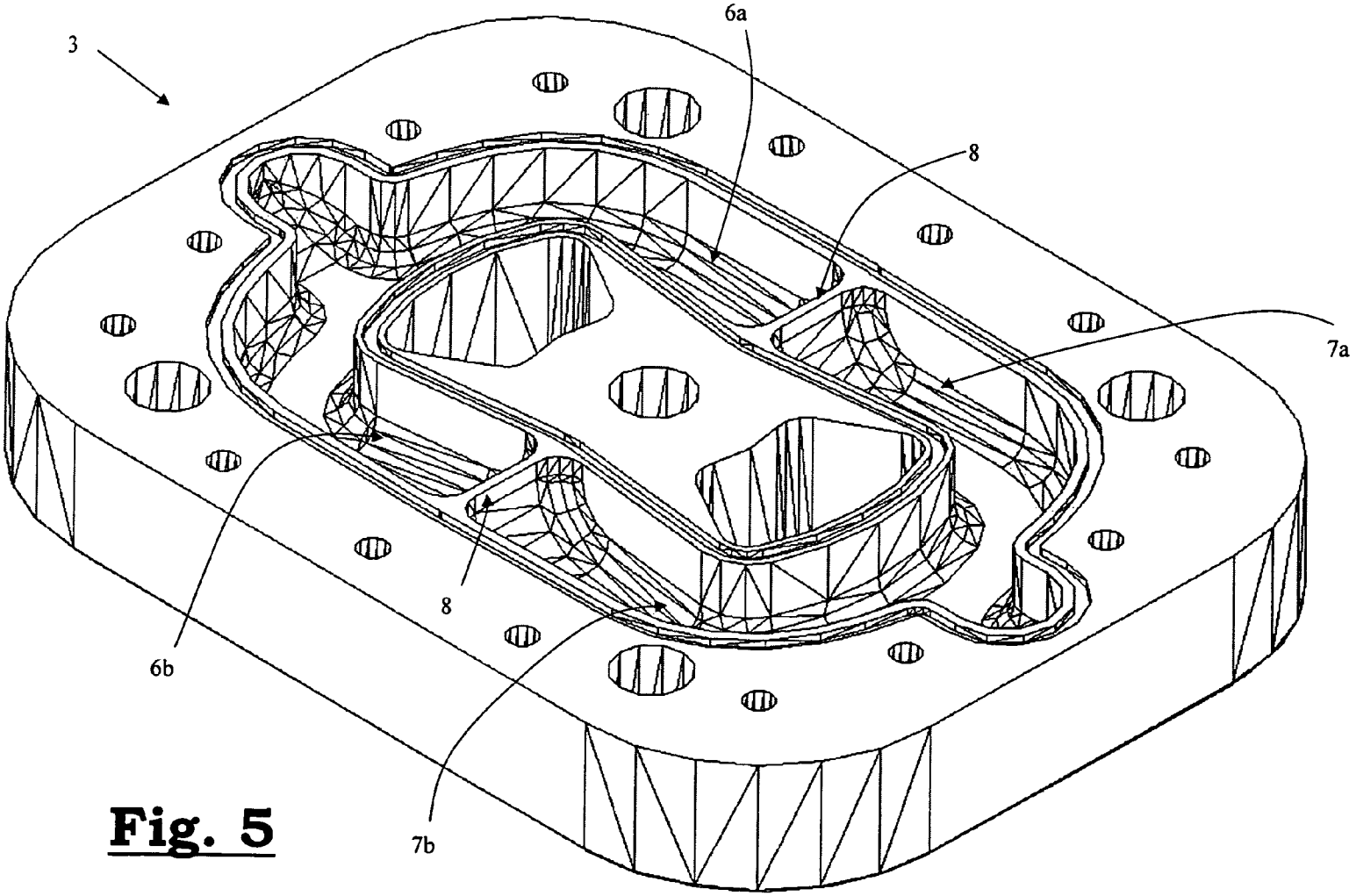
FIG. 5 shows the underside of the mixing plate with an indication of the supply channel and discharge channel.

As illustrated in FIG. 5, the mixing plate (3) comprises, on the one hand, a right depression (6*a*) and a left depression (6*b*) for the formation of a right and a left supply channel, which channels extend on the right and left side respectively of the mixing plate (3). On the other hand, the mixing plate (3) comprises a right depression (7*a*) and a left depression (7*b*) for the formation of a right and a left discharge channel (7*b*), which channels likewise extend on the right and left side respectively of the mixing plate (3). The various channels (right and left supply and discharge channels) are formed by covering the depression by means of the sealing plate (9).

Figure 6:
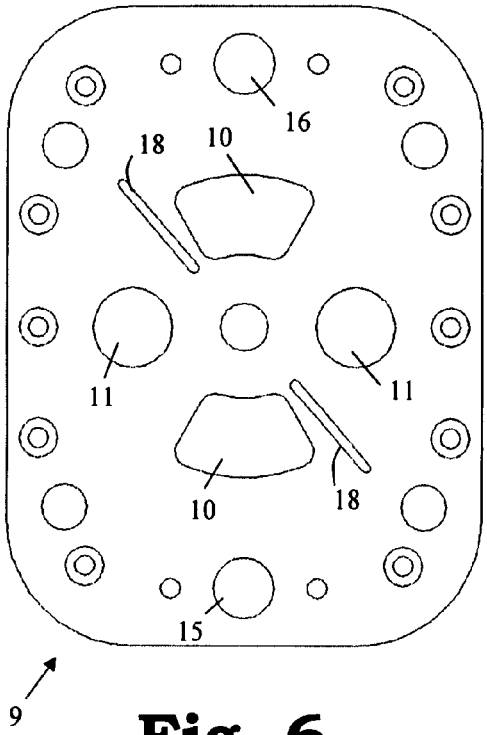
FIG. 6 is a bottom view of the sealing plate.

The sealing plate (9), illustrated, inter alia, in FIG. 6, comprises at least one first aperture, preferably two first apertures (10), which apertures are in communication with the second supply means, and comprises at least one second aperture, preferably two second apertures (11), at the level of the two dividing walls (8), the second apertures (11) connecting to both the supply channel (6) and the discharge channel (7). The sealing plate (9) furthermore comprises a third aperture (15) and a fourth aperture (16), the third aperture (15) connecting, on the one hand, to the supply channels (6) and, on the other hand, to the first supply means (4) for the carrier gas, and the fourth aperture (16) connecting, on the one hand, to the discharge channels (7) and, on the other hand, to the discharge means (5) for the mixture.

A dividing wall (8) is provided between both the right supply channel (6*a*) and the right discharge channel (7*a*) and the left supply channel (6*b*) and the left discharge channel (7*b*). The dividing walls (8) ensure that the carrier gas flow will be deflected in the direction of the rotatable distribution disc (1) situated below. The dividing wall can close off the passage between supply channel and discharge channel either fully or only partially. In the latter case, part of the carrier gas will flow directly from supply channel to discharge channel, resulting in a reduced pulsating or jolting effect of the carrier gas to the gun.

The mixing plate (3) has at least one filling aperture (14), preferably having two, which connect to the second supply means. The particles from the feed hopper (13) fall through the filling apertures (14) and the first apertures (10) into the cavities (2) of the rotatable distribution disc (1). The filling of the cavities (2) can be aided by a rotatable knife (17) mounted on the upper side of the mixing plate (3). The cavities (2) remain filled with particles until they pass below a second aperture (11). At that moment the cavities (2) form part of the carrier gas flow path, and the particles that are present in the cavities (2) are entrained with the carrier gas and sent to the discharge channel (7). The mixture of particles/carrier gas then leaves the mixing device through the fourth aperture (16). In order to project the mixture towards the surface to be treated, a gun is connected by means of a hose or tube to said fourth aperture (16). By providing two fourth apertures, it is also possible to connect two guns to the mixing device.

Before the cavities (2) pass along the filling aperture and are filled again, they first pass along a venting channel (18). As illustrated in FIG. 4, the venting channel (18) is a depression that is provided in the side of the sealing plate (9) facing the rotatable distribution disc (1). The venting channel (18) extends radially beyond the diameter of the distribution disc, thereby producing an opening to the atmosphere through which the excess pressure built up by the carrier gas in the cavities can be released.

The mixing device is designed in such a way that the particles undergo a minimal collision before the particles go into the discharge channel (7). This is achieved by making the second apertures (11) sufficiently large and providing a smooth discharge channel (7). This contrasts with the known systems, which are provided with apertures or openings on their outer circumference. In the case of such systems the particles, before being sent to the discharge channel, will first pass into a larger chamber, where a certain turbulence is present.

Figure 7:
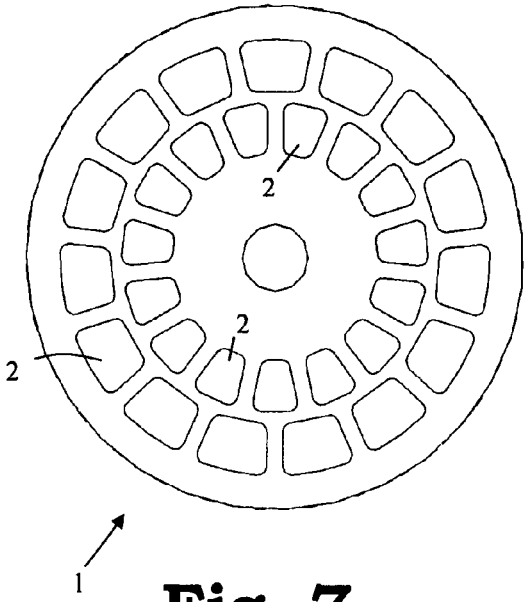
FIG. 7 is a top view of the rotatable distribution disc.

The rotatable distribution disc (1) (see, for example, FIG. 7) comprises one row, preferably two rows, of an uneven number of cavities (2), which are situated at regular intervals. If this is combined with two filling apertures (14) and two second apertures (11) that connect to both the supply channel (6) and the discharge channel (7), it results in uniform mixing of the particles with the carrier gas and an even jet pattern free from pulsations.

The rotatable distribution disc (1) comprises a first series and a second series of cavities (and possibly a third series of cavities), the said series of cavities (2) being placed at a first and second distance (and third distance) respectively from the centre point of the disc (1). If the first and second series of cavities are in an offset position relative to each other, this results in even more uniform mixing of the particles with the carrier gas.

The diameter of the distribution disc (1) and the dimensions of the cavities (2) are selected in such a way that, on the one hand, the friction between distribution disc (1) and sealing plate (9) is kept limited and that, on the other hand, sufficient particles can be mixed with the carrier gas without the speed of rotation becoming so high that the cavities would be only partially filled. Typical speeds of rotation lie in the order of magnitude of 5 to 100 rpm.

In the case of devices working with two filling apertures (14) and two second apertures (11) that connect to both the supply channel (6) and the discharge channel (7), the cavities will be emptied at the first second aperture by a gas flow flowing according to the direction of rotation of the rotatable distribution disc (1), while in the second, second aperture the cavities are emptied by a gas flow flowing in a direction opposite to the direction of rotation of the distribution disc (1). This prevents any build-up of dry ice in the cavities (2).

Figure 8:
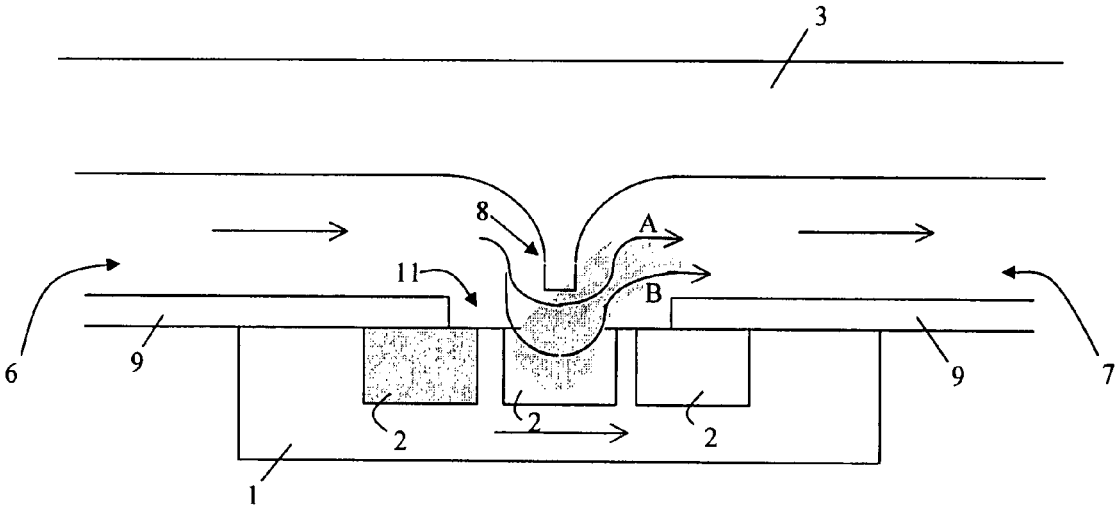
FIG. 8 is a vertical cross section of the mixing device.

Where, as shown in FIG. 8, use is being made of a device wherein the dividing wall only partially closes off the passage between supply channel and discharge channel, only part (indicated by arrow B) of the carrier gas flow will flow through the cavities (2) and entrain the particles accommodated in the cavity (2). A large part of the carrier gas flow will flow above the cavities (2) (indicated by arrow A), and will flow directly through the second aperture (11) into the discharge channel (7). This means that no gas pulsations will occur on the gun.

The device according to the invention is designed in such a way that all moving parts are disposed symmetrically relative to the rotating shaft, and that the pressure with which the seal is produced is in line with the moving shaft. As a result of the symmetrical positioning of both inlets and outlets, no moment of force is generated relative to the rotating shaft. The advantage of this symmetrical design is uniform wear of the rotatable distribution disc (1) and mixing plate (3), and also a great reduction in the wear of these parts. This results in a consistent seal during the service life. Although this is less good for the balance, force and pulsations of the particles, this device also relates to a device with one filling aperture (14), one supply channel (6), one discharge channel (7) and one second aperture (11).

The device according to the invention is designed in such a way that assembly and disassembly are very easy.

In order to have minimal leakage losses of carrier gas when the blow pressure (pressure of the carrier gas) is increased, and in order to limit the friction and use of the distribution disc (1) when the blow pressure is reduced, the seal is preferably made dependent upon the pressure of the carrier gas. In the known mixing devices the pressure-dependent seal is achieved directly at the interface with the rotor (1) and is consequently exposed to very low temperatures as a result of the dry ice. This has the disadvantage that the different components needed to achieve the seal have to meet specific requirements.

In the device according to the invention the pressure-dependent seal is achieved outside the mixing device, and consequently outside the cold zone, with the result that there is no need for specific material. This is achieved as follows: The rotatable distribution disc (1) is mounted on a rotating shaft (19), which is fitted through the hollow shaft of the reductor (21), which is driven by a motor (20). Below the reductor (21), the hollow shaft is supported by a piston (22), which receives counterpressure from a pressure chamber (23) situated on the bottom of the device. The bearing (24) provided on the upper side of the piston (22) prevents the piston (22) and the pressure chamber from rotating. This results in a very simple arrangement. Since the pressure of the pressure chamber (23) is proportional to the blow pressure, a pressure-dependent seal is achieved.

In order to make the pressure of the pressure chamber (23) proportional to the blow pressure, it is obvious to regulate the pressure circuit of the pressure chamber by means of the same pressure valve as that of the blow pressure. Notwithstanding that, this invention also comprises a system wherein the pressure in the pressure chamber (23) is regulated by means of a separate pressure valve. The present invention also relates to systems wherein the sealing pressure is not regulated by means of a pressure chamber, but by means of springs or other means making it possible to achieve a certain pressure between mixing plate (3) and distribution disc (1).

In addition, the rotatable distribution disc (1) is mounted on the hollow shaft in such a way that the connection is not rigid, which makes it possible to accommodate minor alignment differences.

The invention claimed is:

1. Device for particle blasting, comprising:

first supply means (4) for a carrier gas;

second supply means for particles;

a mixing device provided for mixing the particles and the carrier gas, comprising a rotatable distribution disc (1) with one or more cavities (2), which is provided in order to bring the particles into contact with the carrier gas;

discharge means (5) provided for discharging the mixture formed;

wherein the mixing device comprises a mixing plate (3) wherein at least one supply channel (6) for the carrier gas and at least one discharge channel (7) for the mixture are provided, and wherein the rotatable distribution disc (1) is provided in order to position the cavities (2) in such a way during rotation that they form a temporary connection between the at least one supply channel (6) and the at least one discharge channel (7).

2. Device according to claim 1, wherein a dividing wall (8) is provided between the supply channel (6) and the discharge channel (7), and in that the channels (6, 7) are provided in order to achieve the said connection at the level of the dividing wall (8).

3. Device according to claim 1, wherein the mixing device comprises a non-rotatable sealing plate (9), which is disposed between the mixing plate (3) and the rotatable distribution disc (1).

4. Device according to claim 3, wherein the said sealing plate (9) comprises at least one first aperture (10), which is in communication with the second supply means, and in that the said sealing plate (9) comprises at least one second aperture (11) at the level of the dividing wall (8), the second aperture (11) connecting to both the supply channel (6) and the discharge channel (7).

5. Device according to claim 1, wherein the mixing device comprises cutting means for reducing the size of the particles fed in.

6. Device according to claim 1, wherein the rotatable distribution disc (1) comprises at least one series of cavities (2) placed at regular intervals and at equal distances relative to the centre point of the disc, which cavities during rotation of the distribution disc (1) form a temporary connection between the at least one supply channel (6) and the at least one discharge channel (7).

7. Device according to claim 6, wherein the number of cavities (2) per series is an uneven number.

8. Device according to claim 6, wherein the rotatable distribution disc (1) comprises a first series and a second series of cavities, the said series of cavities being placed at a first and a second distance respectively from the centre point of the disc (1).

9. Device according to claim 8, wherein the first and second series of cavities are in an offset position relative to each other.

10. Device according to claim 1, wherein the device comprises pressure means (12) for pressing the rotatable distribution disc (1) against the mixing plate (3).

11. Device according to claim 10, wherein the said pressure means comprise a pressure chamber (23), and the pressure exerted by the pressure chamber (23) is proportional to the pressure of the carrier gas.

12. Device according to claim 11, wherein the said pressure chamber (23) is situated outside the mixing device.

13. Device according to claim 1, wherein the said device is a dry ice blasting device.

* * * * *